US006190190B1

(12) United States Patent
Daly et al.

(10) Patent No.: US 6,190,190 B1
(45) Date of Patent: Feb. 20, 2001

(54) REVERSIBLE SERIAL CONNECTOR FOR DIGITAL DEVICES

(76) Inventors: Thomas Daly, 9 Abenaki Rd., Northboro, MA (US) 01532-2433; Michael Boutin, 8 Elizabeth La., Salem, NH (US) 03079-1348

( * ) Notice: Under 35 U.S.C. 154(b), the term of this patent shall be extended for 0 days.

(21) Appl. No.: 09/136,102

(22) Filed: Aug. 18, 1998

(51) Int. Cl.[7] ..... H01R 27/00
(52) U.S. Cl. ..... 439/218; 439/502
(58) Field of Search ..... 439/218, 217, 439/221, 502, 220

(56) References Cited

U.S. PATENT DOCUMENTS

| | | | | |
|---|---|---|---|---|
| 4,648,682 | * | 3/1987 | Tubbs | 439/502 |
| 5,192,226 | * | 3/1993 | Wang | 439/502 |
| 5,293,013 | * | 3/1994 | Takahashi | 439/620 |
| 5,395,264 | * | 3/1995 | Keith | 439/502 |
| 5,540,601 | * | 7/1996 | Bothcheck | 439/218 |
| 5,557,616 | | 9/1996 | Cadieux et al. . | |
| 5,608,734 | | 3/1997 | Sandler et al. . | |
| 5,637,013 | * | 6/1997 | Webb | 439/502 |
| 5,737,336 | | 4/1998 | Takeda . | |
| 5,757,804 | | 5/1998 | McGee . | |
| 5,792,986 | * | 8/1998 | Lee | 439/502 |
| 5,984,717 | * | 11/1999 | Lee | 439/502 |

* cited by examiner

*Primary Examiner*—Khiem Nguyen
*Assistant Examiner*—J. F. Duverne
(74) *Attorney, Agent, or Firm*—David J. Powsner; Nutter, McClennen & Fish LLP

(57) ABSTRACT

An apparatus which is capable of connecting a first digital device to a modem or to a second digital device includes a cable having at least two wires therein, one wire for transmitting data and one wire for receiving data. A symmetrical plug having at least two prongs terminates the cable such that a corresponding prong on the symmetrical plug receives signals from one of the at least two wires in the cable. The symmetrical plug is operable in at least two orientations. Specifically, the symmetrical plug mates to a corresponding socket in the first digital device in a first orientation and mates to the corresponding socket in the first digital device in the second orientation.

6 Claims, 5 Drawing Sheets

REVERSIBLE SERIAL CONNECTOR FOR DIGITAL DEVICES

BACKGROUND OF THE INVENTION

The present invention is directed to digital communications and, particularly, to connectors for providing serial communications between digital devices.

When providing serial connections between digital devices ("DDs"), it is sometimes appropriate to connect the transmit ("Tx") pin of one DD to the receive ("Rc") pin the other DD and to connect the receive Rc pin of the first DD to the Tx pin of the other DD. This is called a "null modem pin-through" and is typically required, for example, when coupling two computers to one another.

In other instances, it is necessary to connect the Tx pin of the first DD to the Tx pin of the other DD and to connect the Rc pin of the first DD to the Rc pin of the modem. This is typically called a "straight pin-through" and is typically required when one of the DDs is a modem or other such communications device.

Most DDs are provided with an industry-standard serial port, the most common of which is the RS-232 port. This is a 9-pin connector adapted to receive a matching plug. To avoid confusion, the RS-232 port (and other industry standard ports) have a definite "sense," meaning that they mate with corresponding plugs only when the plug and port are oriented in the same direction.

This can be highly convenient, e.g., when connecting a modem to a computer using a standard "serial cable"—that is, a cable with RS-232 plugs wired such that the respective Tx pins are directly connected with one another and, likewise, such that the respective Rc pins of the plugs are directly connected with one another.

However, it can be highly inconvenient when attempting to connect two computers to one another. In this instance, a special adaptor—referred to as a null-modem adaptor—must be utilized effectively to reverse the Tx and Rc pins of one of the DDs. Alternatively, a special cable must be wired, called a null-modem cable, in which the wires connecting the Tx and Rc pins are crossed.

In view of the foregoing, there exists a need for a serial connector which is capable of attaching all types of DDs to one another, regardless of whether the Tx and Rc pins on one DD are to be directly connected to the Tx and Rc pins, respectively, on another DD; or whether the Tx and Rc pin connections are to be reversed.

SUMMARY OF THE INVENTION

The present invention addresses the foregoing needs by using a reversible plug and socket combination for serial communications. When the plug is connected to the socket at one orientation, e.g., the "modem" orientation, the plug and socket can be used to connect DDs that require a straight pin-through connection. On the other hand, when the plug is reversed to connect to the socket at another, different orientation, e.g., the "terminal" orientation, the plug and socket can be used to connect DDs that require a null modem pin-through connection.

In this regard, the plug and socket each have two, and preferably three, conductors that are brought into electrical contact when the plug and socket are mated. For example, the plug may have a Tx prong, an Rc prong, and a Ground prong, while the socket may have a Tx sleeve, an Rc sleeve, and a Ground sleeve.

When the plug and socket are mated in the modem orientation, the Tx prong and sleeve come into electrical contact; the Rc prong and sleeve come into electrical contact; and the Ground prong and sleeve come into electrical contact. When mated in the terminal configuration, the Tx prong comes into electrical contact with the Rc sleeve; the Rc prong comes into electrical contact with the Tx sleeve; and the Ground prong and sleeve come into electrical contact. Where only two conductors are provided on the plug and socket, no Ground prong or sleeve is provided.

Thus, the plug and socket can be used to provide either straight pin-through or null modem pin-through connections. For example, if one end of a serial cable is connected to one DD, e.g., via a conventional RS-232 plug/socket combination, the other end of the serial cable can be provided with a reversible plug of the type described herein for mating—in either the "modem" or "terminal" orientations—with a socket as described above. As a result, it is possible to use the same cable to connect a DD to a modem or to another DD, merely by switching the orientations of the plug (e.g., by flipping it). In this manner, the invention eliminates the need for a specialized modem adaptor or similar specialized hardware.

In preferred aspects of the invention, the reversible plug and/or socket are labeled to indicate their respective orientations. For example, wording and/or arrows may be used to indicate the orientation of the plug, i.e., whether it is in the modem orientation or the terminal orientation.

In the discussion that follows, modems and other DDs that require a straight pin-through when attached for serial communications with a computer are collectively referred to as "modems." Computers and other DDs that require a null modem pin-through when attached for serial communications with other computers are collectively referred to as "DDs."

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A more complete understanding of the invention may be attained by reference to the drawings, in which.

DETAILED DESCRIPTION OF THE ILLUSTRATED EMBODIMENT

Figure 1:
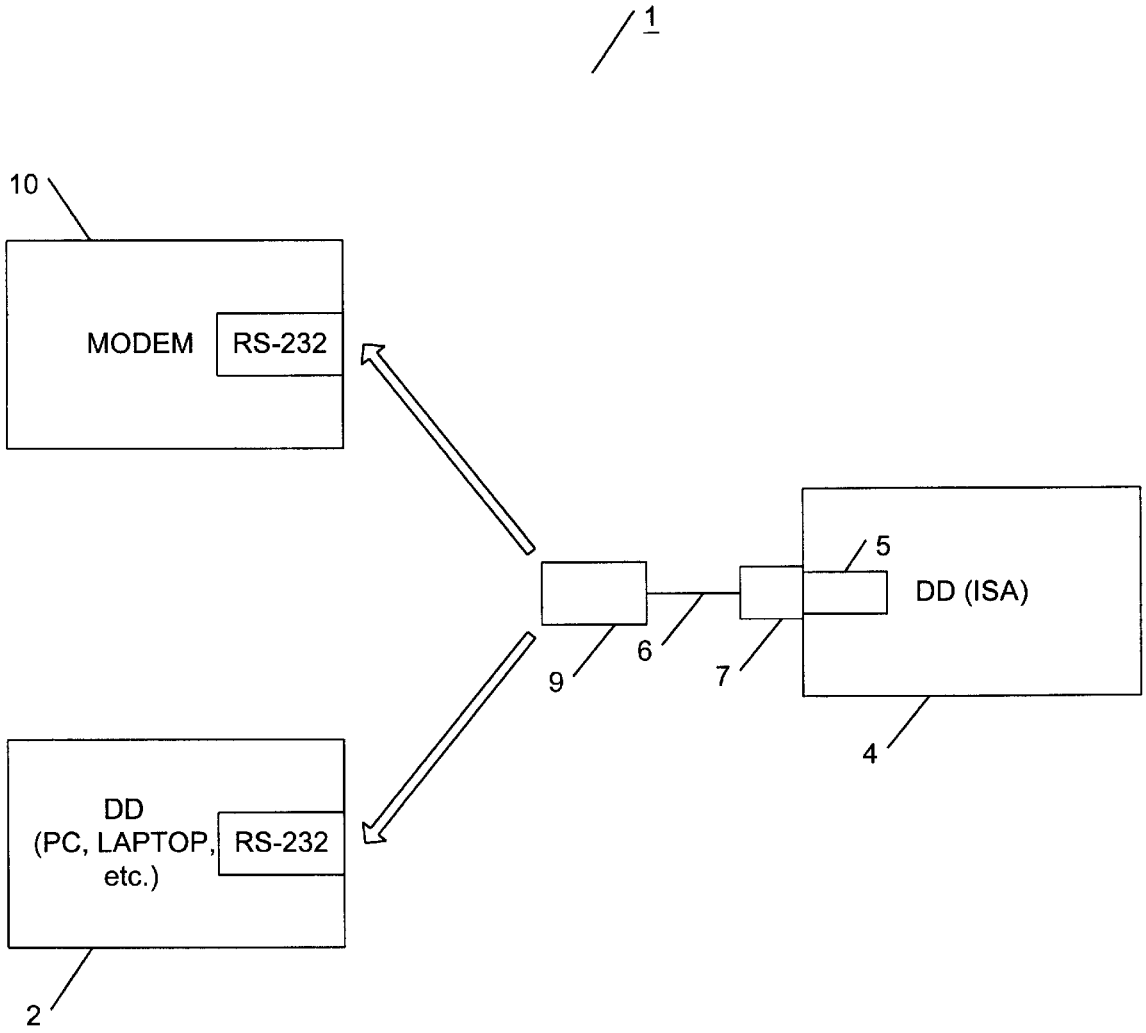
FIG. 1 shows a computer system in which the present invention may be utilized.

FIG. 1 shows a computer system on which the present invention may be implemented. As shown, computer system 1 includes plural DDs 2, 4 and 10. DDs 2 and 4 preferably comprise PCs, laptop computers, or the like, whereas DD 10, in this case, comprises a modem. DDs 2 and 10 include conventional RS-232 serial ports for connecting, e.g., to another DD. DD 4, on the other hand, includes socket 5, which is not a conventional RS-232 port. Instead, socket 5 is a socket having two, or preferably three, sleeves for receiving a two, or preferably three, pronged plug of the type described below.

Figure 2:
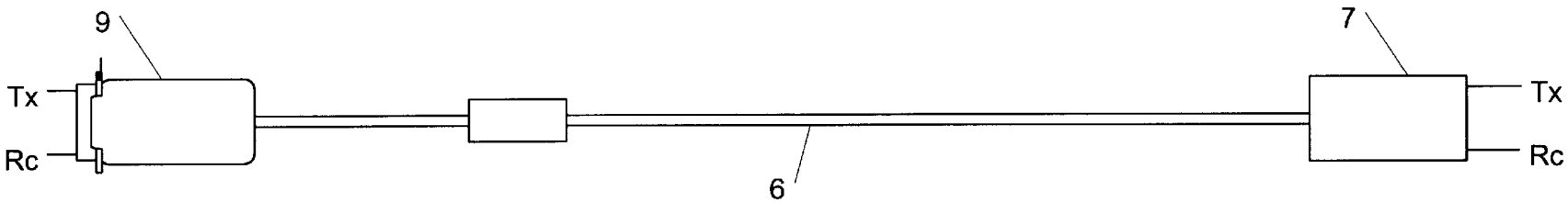
FIG. 2 shows a serial cable which incorporates the present invention.
Figure 3:
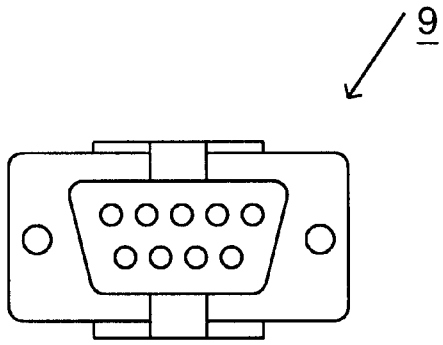
FIG. 3 shows the front view of a conventional serial connector used in the cable shown in FIG. 2.

In the present invention, cable 6 having connectors 7 and 9 at opposite ends thereof is used to connect DD 4 to another DD, such as DD 2 or modem 10. FIG. 2 is a close up view of cable 6 and connectors 7 and 9. As shown in the figure, connector 9 is preferably a standard serial connector, such as an RS-232 serial connector, of the type commonly used on DDs. FIG. 3 is a front view of this connector 9. As shown in FIG. 3, connector 9 includes a standard serial connector pin arrangement, with requisite Tx, Rc and Gnd pins (not labeled) thereon. As is well known to those in the art, this connector is capable of mating only to a compatible connector and only at one orientation, thereby limiting the Tx, Rc and Gnd pins to mating to corresponding Tx, Rc and Gnd pins on a compatible connector.

Figure 4:
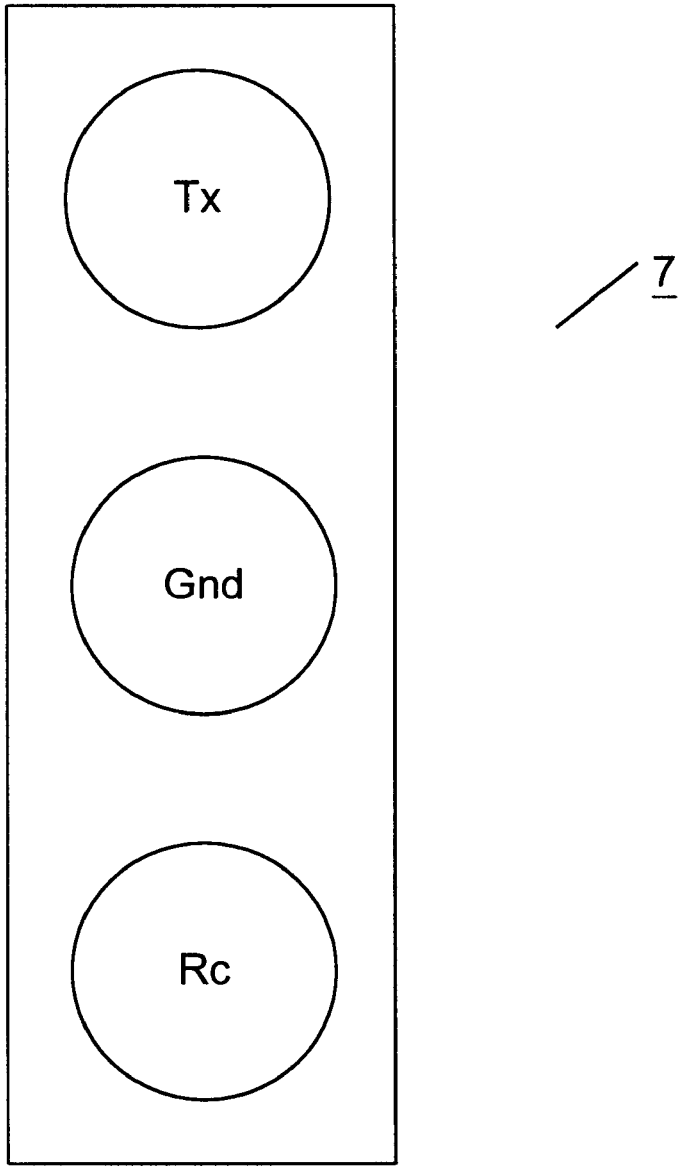
FIG. 4 shows a front view, including pin arrangement, of a reversible connector used in the present invention.

On the other hand, unlike in the prior art described above, the other end of cable 6 includes a symmetrical plug, instead of a standard RS-232 serial connector. In preferred embodiments of the invention, plug 7 includes three pins (or "prongs") thereon. As shown in the front view thereof depicted in FIG. 4, this plug has a symmetrical pin arrangement, whereby its Tx, Rc and Gnd pins are arranged with, e.g., Tx at the top, Gnd in the middle, and Rc at the bottom. Of course, although the invention is described herein with respect to a standard three-pronged plug, the invention can also be used with a standard two-pronged connector having only Rc and Tx pins thereon (i.e., no ground).

Unlike connector 9, plug 7 is capable of mating to a compatible socket, in this case socket 5 on DD 4, in at least two different orientations, or "modes". That is, plug 7 is capable of mating to socket 5 so that either (1) the Tx pin of plug 7 connects to a corresponding Tx sleeve of socket 5 and the Rc pin of plug 7 connects to a corresponding Rc sleeve of socket 5 (i.e., the "modem" mode), or (2) the Tx pin of plug 7 connects to a corresponding Rc sleeve of socket 5 and the Rc pin of plug 7 connects to a corresponding Tx sleeve of socket 5 (i.e., the "terminal" mode). These different orientations can be obtained merely by reversing (e.g., flipping) the plug. As a result, it is possible to effect a serial connection between a DD and either a modem or another DD, without using any additional adaptors, other hardware, or the like.

Moreover, because the Tx and Rc pins of plug 7 are symmetric with respect to its Gnd pin, the Gnd connection between plug 7 and socket 5 remains the same regardless of the orientation of plug 7. As a result, the present invention eliminates the need to perform any rewiring or the like in order to maintain ground connections. Any standard serial communications protocol can therefore be used across cable 6.

Figure 5A:
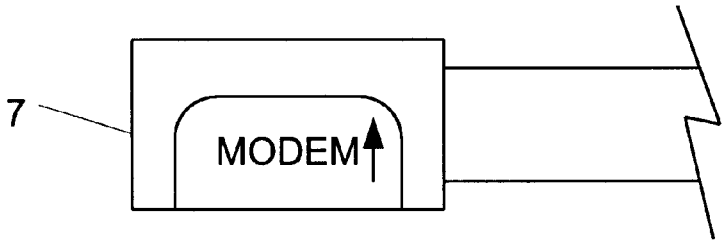
FIGS. 5A, 5B and 5C show different side views and orientations of the reversible connector shown in FIGS. 2 and 4.
Figure 5B:
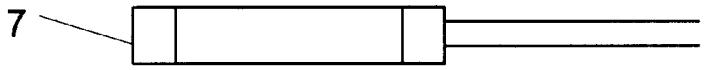
Figure 5C:
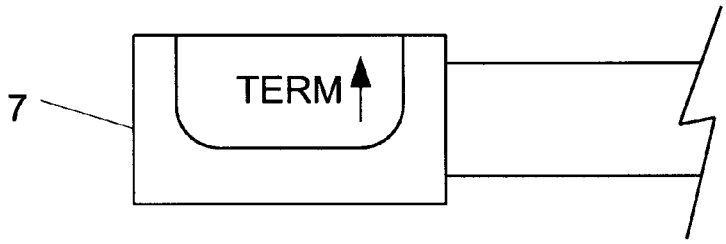
Figure 6:
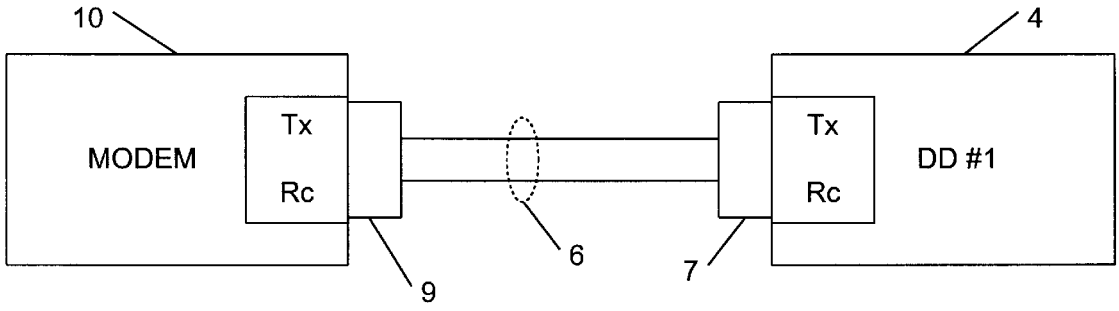
FIG. 6 shows, in the abstract, connection of a DD to a modem using the cable and connectors of FIG. 2.
Figure 7:
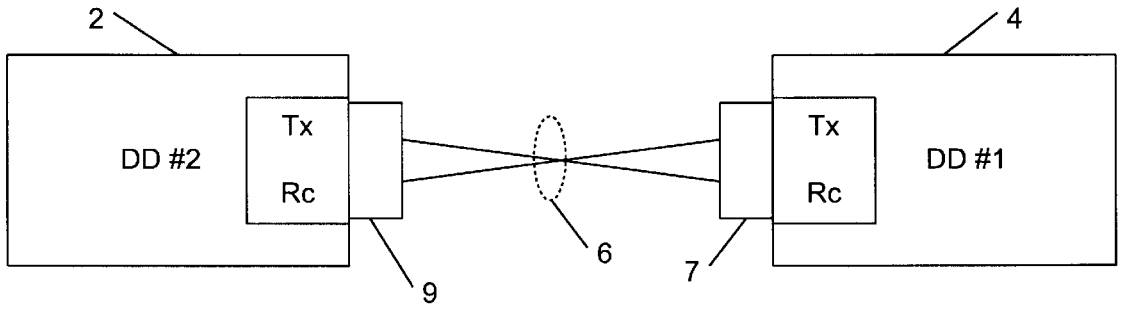
FIG. 7 shows, in the abstract, connection of a first DD to a second DD using the cable and connectors of FIG. 2.

FIGS. 5A, 5B and 5C show different side views of plug 7. As shown in FIGS. 5A and 5C, preferred embodiments of the present invention include labeling, here arrows and words, to provide an indication to the user as to the orientation of the plug. More specifically, FIG. 5A shows a first orientation of plug 7, in which "TERM" and its corresponding arrow face upwards to indicate a connection in "terminal" mode. On the other hand, FIG. 5C shows a second orientation of plug 7, in which "MODEM" and its corresponding arrow face upwards to indicate a connection in "modem" mode. FIG. 6 shows, in the abstract, pin connections of DD 4 to modem 10 using plug 7; and FIG. 7 shows connection of DD 2 to DD 4 also using plug 7 (Gnd connections not shown in either case).

At this point, it is noted that although the present invention, particularly in FIG. 2, has been shown with respect to using a three-pronged plug at only one end of cable 6, the invention is not limited to this configuration. That is, in other embodiments, a three-pronged plug of the type shown in FIGS. 4, 5A, 5B and 5C may be used at both ends of the cable. In this case, of course, corresponding sockets must be provided in for all DDs, including modems. Moreover, it is noted the invention can also be used with a different labeling scheme than that shown in FIGS. 5A and 5C. Finally, it is noted that although the invention has been described herein with respect to connecting between two computers or between a computer and a modem, the invention can also be used to connect between two modems or, in fact, between any two electronic devices that include Tx, Rc and GND pins.

In this regard, the present invention has been described with respect to a particular illustrative embodiment. It is to be understood that the invention is not limited to the above-described embodiment and modifications thereto, and that various changes and modifications may be made by those of ordinary skill in the art without departing from the spirit and scope of the invention.

In view of the foregoing, what is claimed is:

1. An apparatus which is capable of connecting a first digital device to a modem or to a second digital device, the apparatus comprising a cable having at least two wires therein, one wire for transmitting data and one wire for receiving data; and a symmetrical plug having at least two prongs terminating the cable such that a corresponding prong on the symmetrical plug receives signals from one of the at least two wires in the cable;

wherein the symmetrical plug is operable in at least two orientations, each of the orientations of the plug being accessible from the other orientation through a rotation of the plug about an axis, and wherein the symmetrical plug mates to a corresponding socket in the first digital device in a first orientation and mates to the corresponding socket in the first digital device in the second orientation.

2. An apparatus according to claim 1, wherein the symmetrical plug is a standard three-pronged connector having a transmit ("Tx") pin, a ground ("Gnd") pin, and a receive ("Rc") pin;

wherein, in the first orientation the three-pronged connector connects a Tx pin of the first digital device to an Rc pin of the second digital device, a Gnd pin of the first digital device to a Gnd pin of the second digital device, and an Rc pin of the first digital device to a Tx pin of the second digital device; and wherein, in the second orientation the three-pronged connector connects a Tx pin of the first digital device to a Tx pin of the modem, a Gnd pin of the first digital device to a Gnd pin of the modem, and an Rc pin of the first digital device to an Rc pin of the modem.

3. An apparatus according to claim 1, further comprising a standard serial connecter connected to an opposite end of the cable as the symmetrical plug, the standard serial connector for interfacing to a compatible connector on either the modem or the second digital device.

4. An apparatus according to claim 1, wherein the symmetrical plug is labeled so as to indicate an orientation thereof.

5. An apparatus according to claim 4, wherein the symmetrical plug includes a first label on one side thereof which indicates that the symmetrical plug is disposed in the first orientation, and a second label on another side thereof which indicates that the symmetrical plug is disposed in the second orientation.

6. An apparatus according to claim 1, wherein the symmetrical plug comprises a three-pronged connector having a transmit ("Tx") pin, a ground ("Gnd") pin, and a receive ("Rc") pin, and wherein the Tx pin and the Rc pin are disposed symmetrically around the ground pin.

* * * * *